US006637730B2

(12) United States Patent
Blixt

(10) Patent No.: US 6,637,730 B2
(45) Date of Patent: Oct. 28, 2003

(54) CARBURETTOR FOR AN INTERNAL COMBUSTION ENGINE

(76) Inventor: Michael Blixt, Bagaretorp S-611 92, Nyköping (SE)

( * ) Notice: Subject to any disclaimer, the term of this patent is extended or adjusted under 35 U.S.C. 154(b) by 0 days.

(21) Appl. No.: 10/221,670

(22) PCT Filed: Mar. 15, 2001

(86) PCT No.: PCT/SE01/00538

§ 371 (c)(1),
(2), (4) Date: Sep. 16, 2002

(87) PCT Pub. No.: WO01/69071

PCT Pub. Date: Sep. 20, 2001

(65) Prior Publication Data

US 2003/0047819 A1 Mar. 13, 2003

(30) Foreign Application Priority Data

Mar. 17, 2000 (SE) ..... 0000875

(51) Int. Cl.[7] ..... F02M 7/22
(52) U.S. Cl. ..... 261/44.4; 261/51; 261/DIG. 49
(58) Field of Search ..... 261/44.3, 44.4, 261/51, 50.1, 50.2, DIG. 49

(56) References Cited

U.S. PATENT DOCUMENTS 1,793,148 A 2/1931 Warlay ..... 261/44.3
4,013,741 A * 3/1977 Edmonston ..... 261/44.3
4,044,080 A 8/1977 Matsumoto et al. . 261/DIG. 55
4,123,479 A 10/1978 Andreassen ..... 261/DIG. 38
4,150,070 A * 4/1979 Hashimoto et al. ..... 261/41.4
4,443,388 A * 4/1984 Teramura et al. ..... 261/39.2
4,524,034 A * 6/1985 Ellison ..... 261/44.2
4,627,401 A * 12/1986 Brandner et al. ..... 123/439
4,670,194 A * 6/1987 Buford et al. ..... 261/36.2
4,814,115 A * 3/1989 Hashimoto et al. ..... 261/44.3
5,258,143 A * 11/1993 Wang ..... 261/44.3
5,378,411 A * 1/1995 Iwaki et al. ..... 261/39.2
6,164,631 A * 12/2000 Seliminsky ..... 261/44.4

* cited by examiner

*Primary Examiner*—Richard L. Chiesa
(74) *Attorney, Agent, or Firm*—Nixon & Vanderhye P.C

(57) ABSTRACT

Carburettor for an internal combustion engine showing a suction port (1) which is in connection with the combustion chamber of the motor and which is fed with liquid fuel via a nozzle (3) and a fuel channel (3.1), which leads into the suction port (1). A linearly movable valve needle (5) is arranged to extend into the fuel channel (3.1) mainly perpendicular to its longitudinal direction and to open or close this, whereby the suction port (1) is possible to throttle down or close with a throttle (4) which is moveable between an open position and a closed position. The valve needle (5) is in connection with a manoeuvre arm (6), which in turn is in connection with the throttle (4) and is arranged to open the nozzle (3) when the throttle (4) is opened and to close when the throttle (4) is closed.

4 Claims, 3 Drawing Sheets

CARBURETTOR FOR AN INTERNAL COMBUSTION ENGINE

This application is the US national phase of international application PCT/SE01/00538 filed Mar. 15, 2001 which designated the U.S.

TECHNICAL SPHERE

The present invention concerns a carburettor for an internal combustion engine showing a suction port which is in connection with the combustion chamber of the motor and which is fed by liquid fuel via a nozzle and a fuel channel which leads into the suction port. A linearly movable valve needle is arranged to extend into the fuel channel mainly perpendicular to its longitudinal direction and to open or close it. The suction port is possible to throttle down or to close with a throttle which is movable between an open position and a closed position.

BACKGROUND

Carburettors for internal combustion engines, for example motorcycles, show a suction port which is in connection with the combustion chamber of the motor and which is fed with liquid fuel via a nozzle. The suction port is possible to throttle down and to close with a throttle, which is movable between an open position, and a closed position. The throttle may be cylindrical or of a sheet form and be manoeuvred with the aid of a wire which is in connection with a so called throttle twist grip. The nozzle is usually in connection with a fuel channel which leads into the suction port and is opened and closed with the aid a valve needle which is extending down into the opening of the fuel channel in a direction from the suction port. The valve needle may be rigidly mounted upon the throttle or be in connection with this via a wire. When the suction port is totally open the valve needle or the wire extends across the suction port.

At motorcycles for racing the motors for cycles in the same racing class are to keep certain measures and dimensions. Also the size of the suction port is limited to a maximum diameter. It has been shown that the motor effect could be increased at a given diameter of the suction port if the placement of the valve needle or the corresponding wire across the suction port could be avoided. The American patent publications U.S. Pat. No. 1,793,148 and U.S. Pat. No. 4,123,479 describes carburettors where the suction openings are not influenced by wires or valve needles but they are not suitable for use with among other things motors for motorcycles for racing.

DESCRIPTION OF THE INVENTION

The purpose of the present invention is to achieve a carburettor for an internal combustion engine, which is better than the previously known carburettor constructions. The carburettor according to the invention shows a suction port which is in connection with the combustion chamber of the motor and which is fed with liquid fuel via a nozzle and a fuel channel, which leads into the suction port. A linearly moveable valve needle is arranged to extend into the fuel channel mainly perpendicular to its longitudinal direction and to open and close this. The suction port is possible to throttle down or to close with a throttle, which is situated on the opposite side of the suction port in relation to the fuel channel orifice, which is moveable between an open position and a closed position. The valve needle is in connection with a manoeuvre arm which is arranged on one side of the suction port and which in turn is in connection with the throttle and is arranged to open the fuel channel when the throttle is opened and to close the same when the throttle is closed.

In a preferred mode of execution of the invention the manoeuvre arm is turnable arranged towards an axis, its one end being in connection with the outer end of the valve needle and its other end being in connection with a wedge formed part arranged upon the throttle.

In a first alternative mode of execution of the invention the axial position of the valve needle in relation to the manoeuvre arm is setable with the aid of an open spring washer, a so called "knaster", which is possible to place in an optional groove in the valve needle and which allows the manoeuvre arm may be fastened in different positions along the length of the valve needle.

In a second alternative mode of execution of the invention the manoeuvre arm may be divided into two parts, whereby a first part abuts the throttle and the second part is in connection with the valve needle and whereby the mutual position of the parts is setable with the aid of a set screw.

In further alternative modes of execution of the invention the manoeuvre arm may be formed like a wedge at that end which is in contact with the valve needle and connected with the throttle so it moves linearly at the movement of the throttle and closes the fuel channel when the throttle is closed.

It is also within the framework of the invention to design the fuel channel in the form of a pipe which extends out a bit into the suction port or to let the nozzle constitute a part of the fuel channel.

Further details and characteristics regarding the invention are evident from the description of the figures below as well as from the patent claims.

A DESCRIPTION OF THE FIGURES

The invention is described below in the form of an example of a mode of execution in connection with the attached figures, which show a schematically drawn carburettor.

Figure 1:
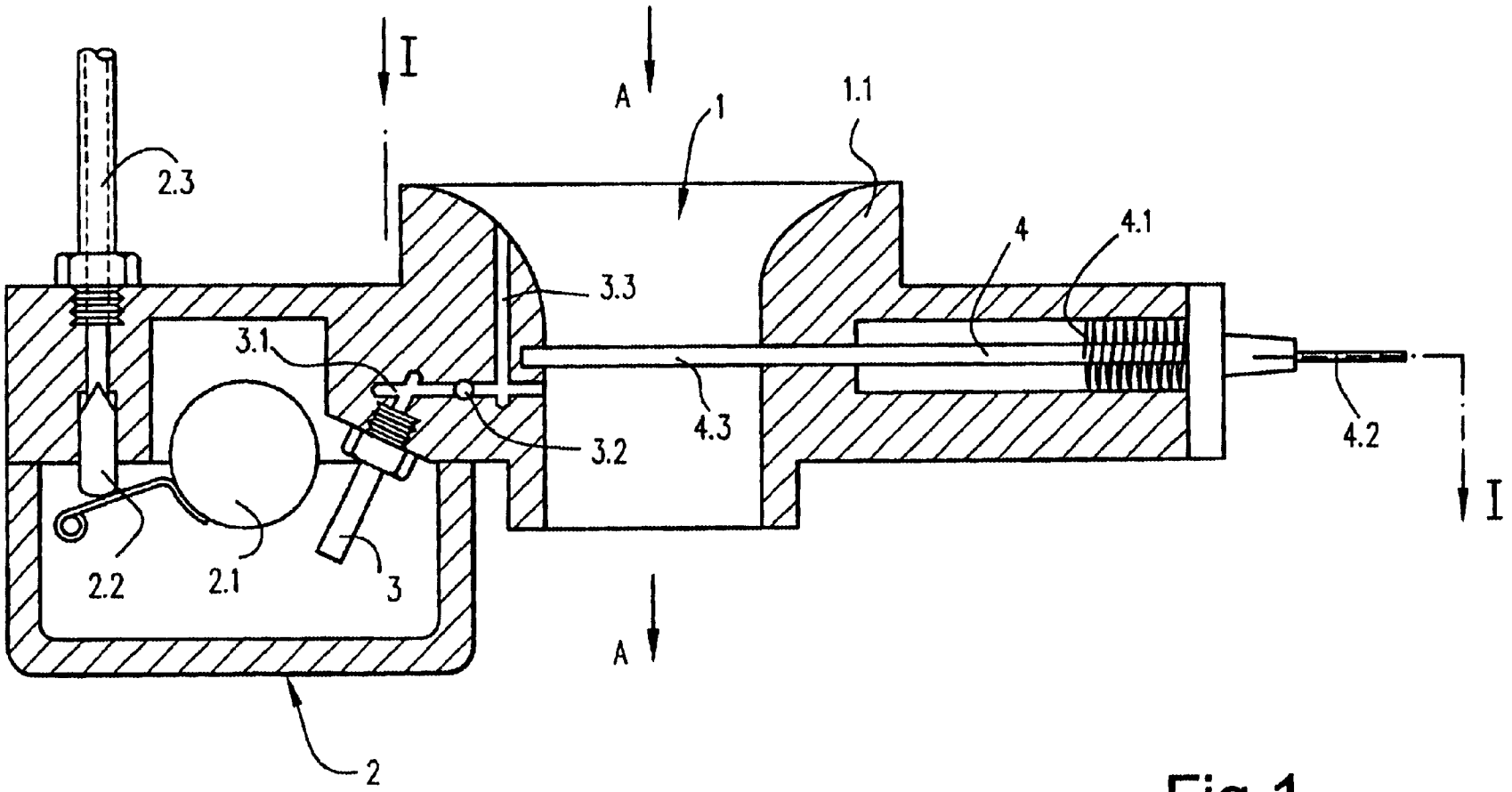
FIG. 1 shows a carburettor according to the invention in a longitudinal section through its suction port and float chamber.
Figure 2:
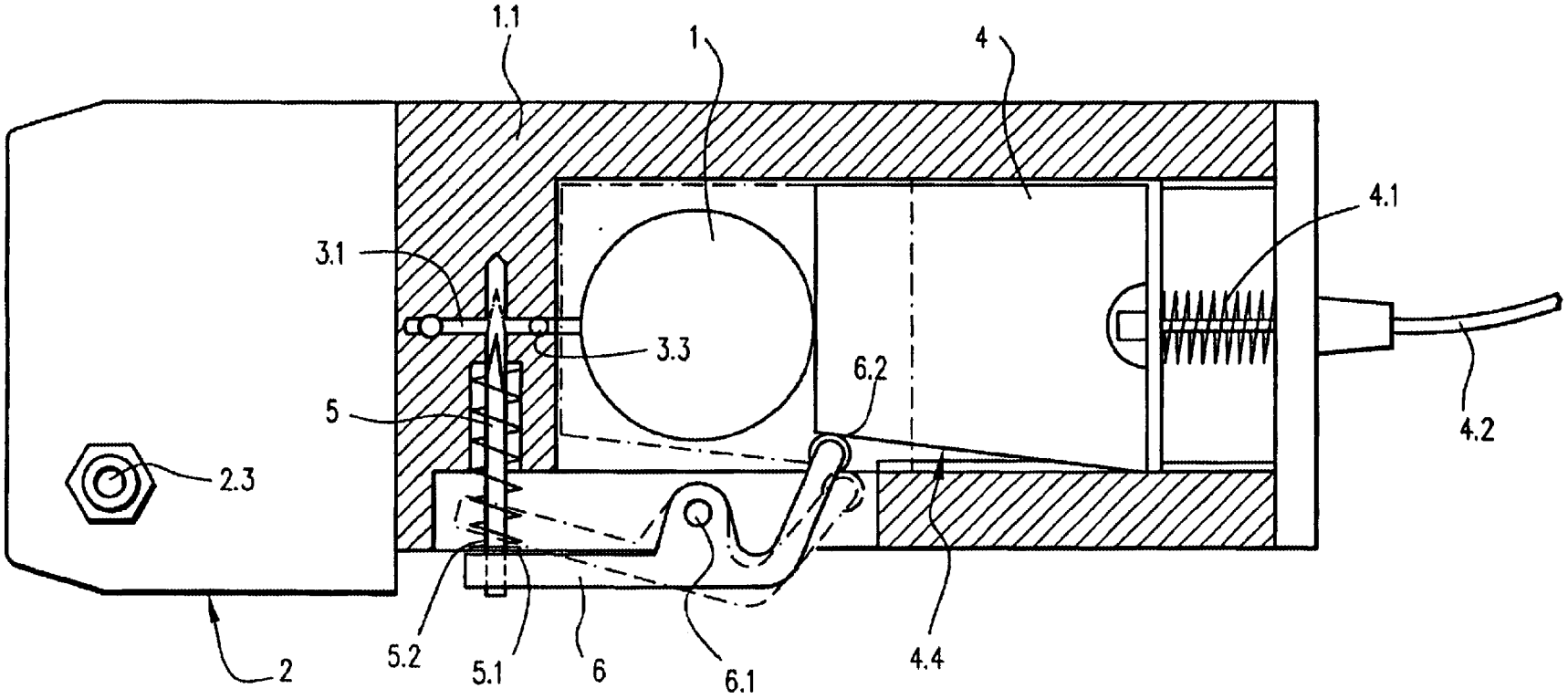
FIG. 2 shows the carburettor according to FIG. 1 partly in a horizontal section along the line I—I in FIG. 1.

The carburettor which is shown in the figure shows a suction port 1 for air arranged in a carburettor body 1.1, which is fed with liquid fuel from a float chamber 2 via a nozzle 3. In the float chamber 2 a float 2.1 is arranged to open and to close a fuel valve 2.2, which is in connection with a fuel pipe 2.3 for delivery of fuel to the float chamber 2. A sheet formed throttle 4 is with the aid of a spring 4.1 arranged to be moved from its opened position, which is shown with full lines in FIG. 2, to its closed position which is shown with dash dotted lines in FIG. 2. The throttle 4 is held in an open position with the aid of a wire 4.2, which is in connection with a throttle twist grip. The throttle 4 moves into parallel grooves 4.3 in the carburettor house, which grooves are arranged on both sides of the throttle 4.

The nozzle 3 is in connection with a fuel channel 3.1 leading to and into the suction port 1 which may be opened or closed with the aid of a valve needle 5 which is arranged to extend perpendicular into a hole 3.2 in the fuel channel 3.1 and to monitor the feeding of fuel to the suction port 1.

An air channel 3.3 for emulsifying air extends from a ring formed hopper 1.1 which is surrounding the suction port 1 and into the fuel channel 3.1. The valve needle 5 is influenced by a manoeuvre arm 6, which is in connection with the outer end of the valve needle 5 and also in connection with an edge 4.4, which is wedgelike sloping upon the throttle 4. The manoeuvre arm 6 extends totally on one side of the suction port 1 and does not intrude on this but allows an undisturbed flow through of air.

The position of the valve needle 5 in the longitudinal direction is setable with the aid of an open spring washer 5.1, a so called "knaster", which is placed in some of the ring formed recesses 5.2 that are arranged in the outer end of the valve needle 5. A helical spring 5.3 holds the valve needle 5 pressed outwards from the fuel channel 1 when the throttle 4 is in different degrees of opening. The manoeuvre arm 6 shows a roll 6.2 in its end which abuts the sloping edge 4.4 upon the throttle 4 and is turned around the axis 6.1 when the throttle 4 is moved from its open position to its closed position, which is shown with dash dotted lines in FIG. 2 and vice versa. When the manoeuvre arm 6 is turned the valve needle 5 is moved so that it holds the fuel channel 3.1 closed when the throttle 4 is in its closed position and open when the throttle 4 is in an open position.

Figure 3:
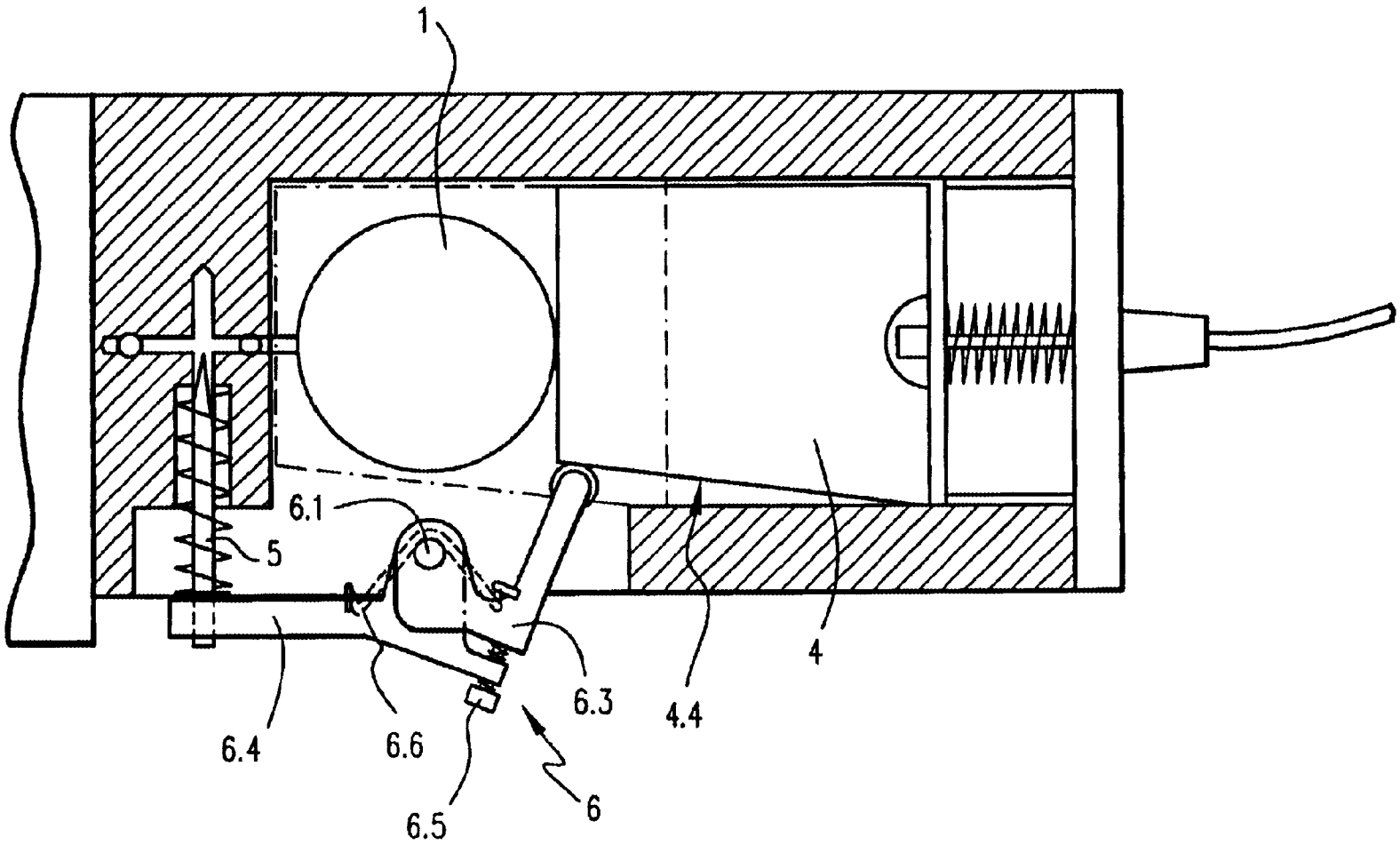
FIG. 3 shows enlarged a part of an alternative mode of execution of the carburettor according the invention.

In FIG. 3 an alternative mode of execution of the carburettor according to the invention is shown where the manoeuvre arm 6 is divided into two parts, whereby the first part 6.3 abuts the wedge formed edge 4.4 upon the throttle 4 and the second part 6.4 is in connection with the valve needle 5. The two manoeuvre arm parts 6.3, 6.4 each one is turnable around the axis 6.1 and setable with the aid of a set screw 6.5. The first part 6.3 is held pressed against the set screw 6.5 upon the other part 6.4 with the aid of a spring 6.6. By turning the set screw 6.5 the position of the valve needle 5 in relation to the position of the throttle 4 may be set. This solution replaces the adjustment with a spring washer which is described above.

The edge 4.4 of the throttle 4 may also be given other forms than a wedge form depending on if the movement of the valve needle 5 may be other than linearly dependent upon the movement of the throttle 4.

What is claimed is:

1. Carburettor for an internal combustion engine showing a suction port (1) arranged in a carburettor body (1.1) which is in connection with the combustion chamber of the motor and which is fed with a liquid fuel via a nozzle (3) and a fuel channel (3.1) which is arranged in the carburettor body (1.1) and which leads to the suction port (1), the suction port (1) being possible to throttle down or close down with a throttle (4) which is movable between an open position and a closed position, characterized in that a linearly moveable valve needle (5) is arranged in the carburettor body (1.1) with its inner end being aimed for projecting into the fuel channel (3.1) mainly perpendicular to its longitudinal direction and to open and close this and with its outer end projecting out from the carburettor body (1.1), that the outer end of the valve needle (5) is in connection with a manoeuvre arm (6) which is arranged on the side of the suction port (1) and which is turnable arranged around an axis (6.1), that the other end of the manoeuvre arm (6) is in connection with a wedge formed part (4.4) arranged on one side of the throttle, the manoeuvre arm (6) being arranged to turn and open the nozzle (3) when the throttle (4) is opened and to close when the throttle (4) is closed.

2. Carburettor according to claim 1, characterized in that the axial position of the valve needle (5) in relation to the manoeuvre arm (6) is setable with the aid of an open spring washer (5.2) which is placeable in an optional recess in the valve needle (5).

3. Carburettor according to claim 1, characterized in that the manoeuvre arm (6) is divided into two parts, a first part (6.3) abutting the throttle (4) and a second part (6.4) being in connection with the valve needle (5) and that the mutual position of the parts (6.3, 6.4) is setable with the aid of a setting screw (6.6).

4. Carburettor according to claim 2, characterized in that the manoeuvre arm (6) is divided into two parts, a first part (6.3) abutting the throttle (4) and a second part (6.4) being in connection with the valve needle (5) and that the mutual position of the parts (6.3, 6.4) is setable with the aid of a setting screw (6.6).

* * * * *